United States Patent [19]

Morris

[11] 4,325,895

[45] Apr. 20, 1982

[54] METHOD OF PRODUCING LARGE OBJECTS FROM RAPIDLY QUENCHED NON-EQUILIBRIUM POWDERS

[75] Inventor: David G. Morris, Lausanne, Switzerland

[73] Assignee: Institut Cerac S.A., Lausanne, Switzerland

[21] Appl. No.: 167,437

[22] Filed: Jul. 9, 1980

[30] Foreign Application Priority Data

Jul. 9, 1979 [SE] Sweden ..... 7905952

[51] Int. Cl.[3] ..... B06B 3/00

[52] U.S. Cl. ..... 264/23; 264/25; 264/111; 264/120

[58] Field of Search ..... 264/120, 23, 25, 111

[56] References Cited

U.S. PATENT DOCUMENTS

| | | | |
|---|---|---|---|
| 3,662,052 | 5/1972 | Nowak et al. | 264/120 |
| 3,717,427 | 2/1973 | Bodine | 264/23 |
| 4,000,231 | 12/1976 | Peterson | 264/120 |

*Primary Examiner*—James R. Hall

*Attorney, Agent, or Firm*—Eric Y. Munson

[57] ABSTRACT

A method of producing large objects from rapidly quenched non-equilibrium powders in which the powder is first slowly precompacted to a predetermined density without causing any substantial temperature rise. The powder is then rapidly compacted by a shock wave having a short rise time. In this way thin surface regions on the particles are rapidly brought to melting to cause interwelding of the particles. These thin surface regions are then rapidly quenched by conduction of heat to the interior of the particles. Because of the very rapid heating and quenching, in the order of a few microseconds, degradation of the material is avoided.

1 Claim, No Drawings

METHOD OF PRODUCING LARGE OBJECTS FROM RAPIDLY QUENCHED NON-EQUILIBRIUM POWDERS

The present invention relates to a method of producing large objects from rapidly quenched non-equilibrium powder particles, such as amorphous or supersaturated metal powders.

The materials considered for the present invention have up to now only been producible in thicknesses of 100 μm or less. These materials are produced by rapidly quenching the material from a liquid state. The cooling rate necessary is of the order of $10^{6°}$ C./sec. For each material there is a critical temperature which cannot be exceeded, at least not considerably, for more than a short time if degradation of the material is to be avoided. This critical temperature is e.g. about 400° C. for the amorphous alloy sold under the trade mark METGLAS 2826, a trademark of the Allied Chemical Corporation for metallic glass having a composition of 40% nickel, 40% iron, 18% phosphorous, and 6% boron. This is far below the melting point of the material. The high cooling rate necessary at the production stage and the impossibility to exceed the critical temperature substantially for more than a very short time has up to now made it impossible to produce pieces having a thickness of more than about 50 μm. For certain materials and maximum thickness is even considerably less, e.g. 20 μm.

The object of the present invention is to suggest a method of producing large objects from rapidly quenched non-equilibrium powder particles. According to the invention it is suggested that these powder particles are precompacted to a predetermined density, e.g. by pressing slowly so that the powder remains substantially at room temperature. The powder is then positioned in a confined space and further compacted by propagation of a shock wave, having a short rise time, through the powder. Since the pressure is increased very rapidly the surface regions of the particles are quickly heated to the melting point of the material to cause interwelding of the particles. The surface regions of the particles are then rapidly quenched by conduction of heat therefrom to the interior of the particles so that subsequent degradation of the material is avoided.

In order to obtain a satisfactory result it is absolutely necessary that the time during which any part of the material is at a temperature considerably above the critical temperature is very short, should be in the order of a few microseconds or less. It is therefore necessary to heat the material very rapidly so that only the surface regions of the particles reach the melting point of the material. In order not to produce too much heat in obtaining surface melting the powder must be precompacted to a certain density which depends on the material being used. The effect obtained with the precompaction is that the subsequent shock wave will create a much quicker pressure rise in the powder so that the melting point will be reached at the surfaces of the particles with considerably less energy being introduced into the powder. This means that actually only a very small fraction of the powder volume is heated to the melting point of the material. Therefore, melting of the powder volume occurs only in a thin layer at the particle surface. These particle surfaces are then rapidly quenched by conduction of heat to the interior of the particles. Because melting occurs only in a thin layer at the particle surface and thus the volume of melted material is small as compared to its overall volume, all portions of each particle will be at a temperature below the critical temperature within a very short time, of the order of one microsecond. Since the heating time also is of the order of one microsecond the whole bonding process will be completed within a few microseconds. Since the material then lies at a temperature below the critical temperature, which for iron-based materials is in the order of 400° C., degradation of the material is avoided. It should be noted that particles suitable for being used with the present invention should not be porous because then the interior of the particles would be heated as a result of substantial particle compression.

The amount of precompaction which should be used in order to reduce the amount of energy, and thus the amount of heat, necessary for obtaining surface melting of the particles varies from material to material. Good results have been obtained with iron-based materials when the powder has been precompacted to a density of 40-60% of that of a solid body.

The size of the objects that can be produced with the method according to the present invention is only limited by the size of the machine used. The shock wave is preferably created by launching a projectile, which could be of steel, a plastic material or another material, against the powder. Therefore, one can, in principle, make products or objects of virtually any size and of many different shapes is suitable dies are used to confine the powder during the compaction.

With the present invention it is possible to use the special properties which one finds in rapidly quenched non-equilibrium materials for a great number of applications which have been impossible up to now. Such properties could be e.g. high hardness, high ductility, good corrosion resistance, good magnetic properties for amorphous metals, i.e. metals having no crystals. Furthermore, good tool materials can be produced with super-saturated materials, i.e. a material containing substantially more of one or several additives than can e produced with conventional techniques, as well as with the amorphous materials. In addition to this both the amorphous and the super-saturated materials can advantageously be used in other applications where their special properties make them particularly suitable.

Three examples are given below showing that the original nonequilibrium structure of the powder is retained when large objects are produced according to the present invention.

EXAMPLE 1.

An amorphous alloy, sold by Allied Chemical Corporation under the trade mark METGLAS 2826, a trademark of the Allied Chemical Corporation for metallic glass having a composition of 40% nickel, 40% iron, 18% phosphorous, and 6% boron, in form of a ribbon approximately 1.6 mm wide and 50μm thick was cut into pieces approximately 1 mm long to produce powder. The composition of this material is 40% Nickel, 40% Iron, 14% Phosphorus, 6% Boron. The powder was precompacted in a chamber of 25mm diameter to a density of 3.5g/cm$^3$ (approximately 45% of full density). The powder was then impacted by an Entacetal (polyacetal resin) piston of 25 mm diameter and 30 mm long at a velocity of 1500m/s. The object thus produced was fully amorphous.

EXAMPLE 2.

A M2 Tool Steel Powder of approximately 100μm particle size, sold by Davy-Loewy Ltd of Bedford, England, having a nonequilibrium structure comprising ferritic and austenitic solid solutions, its composition being Iron base, 6% Tungsten, 5% Molybdenum, 2% Vanadium, 4% Chromium, and near 1% Carbon, was precompacted in a chamber of 25 mm diameter to a density of 4 g/cm$^3$ (approximately 50% of full density). M2is the British standard for Tool Steel of the approximate composition of 6% tungston, 5% molybdenum, 4% chromium, 2% vanadium, 1% carbon and an iron base. The powder was then impacted by an Entacetal (polyacetal resin) piston of 25 mm diameter and 30 mm long at a velocity of 2000 m/s. The object thus produced retained the original non-equilibrium structure of the powder.

EXAMPLE 3.

A Grade MD-76 alloyed aluminum powder a grade of premixed aluminum powder containing principally 1.6 % copper, 2.5% magnesium, and 5.6% zinc mixed in powder form with a base of aluminum, of approximately 100μm particle size, sold by Alcan Metal Powders of New Jersey, U.S.A. a division of Alcan Aluminum Corporation, was given a solutionising and quench treatment to produce a non-equilibrium supersaturated powder solution and precompacted in a chamber of 25 mm diameter to a density of 1.7 g/cm$^3$ (approximately 60% of fulldensity). The powder was then impacted by an ertacetal piston of 25 mm diameter and 30 mm long at a velocity of 1000 m/s. The object thus produced retained the non-equilibrium supersaturated state of the powder.

What is claimed is:

1. In a method of producing larger objects by bonding together smaller non-equilibrium particles of amorphous or metallic powders, the steps of said method including positioning said powder in a confined space, and applying a shock wave thereto, said particles to be bonded having a critical temperature, below the melting temperature thereof, above which critical temperature thermal degradation can occur, that improvement comprising:

precompacting said powder to a density of 30% to 60% of that of a solid body formed from said powder before applying said shock wave to said powder, applying said shock wave to said precompacted powder so that only the surfaces of said powder particles are heated to their melting temperature and the temperature of said particles is above said critical temperature for a time period of the order of magnitude of not more than a few microseconds, the heat at said particles surfaces being conducted to the interiors of said particles to quench the heated particle surfaces, wherein all portions of said particles are at a temperature below said critical temperature and the outer surfaces of said particles are bonded together within the order of a few microseconds after said shock wave is applied thereto.

* * * * *